US006077110A

United States Patent [19]

Okabe et al.

[11] Patent Number: 6,077,110

[45] Date of Patent: Jun. 20, 2000

[54] CONNECTOR

[75] Inventors: Toshiaki Okabe; Mitsuharu Nakamura, both of Shizuoka, Japan

[73] Assignee: Yazaki Corporation, Tokyo, Japan

[21] Appl. No.: 09/097,662

[22] Filed: Jun. 16, 1998

[30] Foreign Application Priority Data

Jun. 16, 1997 [JP] Japan ..... 9-158805

[51] Int. Cl.[7] ..... H01R 31/08

[52] U.S. Cl. ..... 439/516; 439/512

[58] Field of Search ..... 439/516, 510, 439/511, 512

[56] References Cited

U.S. PATENT DOCUMENTS

| | | | |
|---|---|---|---|
| 3,932,013 | 1/1976 | Yeager et al. | 439/510 |
| 4,383,724 | 5/1983 | Verhoeven | 439/510 |
| 4,470,651 | 9/1984 | Schwab | 439/510 |
| 4,602,834 | 7/1986 | Hahn et al. | 439/510 |
| 4,607,899 | 8/1986 | Romine et al. | 439/512 |
| 5,782,655 | 7/1998 | Stefaniu et al. | 439/510 |

FOREIGN PATENT DOCUMENTS

| | | | |
|---|---|---|---|
| 6-36817 | 2/1994 | Japan | H01R 13/02 |

*Primary Examiner*—Renee S. Luebke
*Assistant Examiner*—T. C. Patel
*Attorney, Agent, or Firm*—Sughrue, Mion, Zinn, Macpeak & Seas, PLLC

[57] ABSTRACT

A connector is disclosed. The connector comprises a housing, a plurality of terminal receiving grooves defined by a partition wall, a notch formed at one end portion of the respective partition wall, a plurality of terminals accommodated within the terminal receiving grooves, and an interconnecting portion which electrically interconnects at least two adjacent ones of the plurality of terminal portions each other and is disposed in the notch.

11 Claims, 7 Drawing Sheets

CONNECTOR

BACKGROUND OF THE INVENTION

1. Field of the Present Invention

This invention relates to a connector, and more particularly to a connector with a joint terminal, which is used, for example, for a wire harness in an automobile, or is used for connecting wires of various electronic equipments.

2. Background of the Related Art

One conventional connector includes a joint terminal as shown in FIG. 9 or as disclosed in Unexamined Japanese Patent Publication No. Hei 6-36817. FIG. 9(*a*) is a bottom view of such a joint terminal, FIG. 9(*b*) is a side-elevational view thereof, and FIG. 9(*c*) is a front-elevational view thereof. As shown in FIG. 9, this joint terminal 1 includes parallel, adjacent terminal portions 4 each having a contact portion 2 and a wire connection portion 3, and an interconnecting portion 5 (which is in the form of a flat plate) interconnecting the two terminal portions 4 in an electrically-conductive manner at their central portions each disposed between the contact portion 2 and the wire connection portion 3.

Such a joint terminal 1 is previously formed, for example, by punching into an integral, multiple connected construction having a plurality of terminal portions 4 interconnected by the interconnecting portion or portions 5, and in accordance with a required circuit construction, this integral structure is cut at those portions indicated in chain lines in FIG. 9(*a*), and by doing so, a single-terminal joint terminal, a double-terminal joint terminal or a triple-terminal joint terminal can be formed.

However, when such a conventional joint terminal having the plurality of terminal portions 4 and single terminal portion 4 formed by cutting the joint terminal are to be provided in a mixed manner in a housing of a connector, it has been necessary to prepare a housings of a special design, having those portions where cavity walls are formed and those portions where no such cavity wall is formed, depending on the wiring circuit construction, since the joint terminal has the interconnecting portion 5 formed between the terminal portions 4, so that a cavity wall, separating these terminal portions from each other, can not be formed. Thus, it has been necessary to mold the various housings so as to meet the various joint circuits, and therefore there have been encountered problems that the cost for molds of the housings increases, and that it is necessary to manage the storage of the various housings.

And besides, in the above joint terminal, the terminal portions 4 are interconnected merely by the thin interconnecting portion 5, and therefore the terminal itself has a low strength, and the terminal portions 4 are liable to be twisted or bent with respect to each other. When this joint terminal is received in the housing, the joint terminal is liable to be shaken, and it has been difficult to connect the joint terminal to the housing in an integral manner. As a result, the distal end portion of the terminal is liable to be lifted off the inner surface of the housing, and therefore there have been encountered problems that the wire connection is unstable and that the wire connecting operation is complicated.

SUMMARY OF THE INVENTION

It is therefore an object of this invention to provide a connector in which a general purpose nature of a housing is enhanced, and the stability of the wire connection is enhanced, and the efficiency of a wire connecting operation is enhanced.

According to the first aspect of the present invention, there is provided a connector comprises a housing, a plurality of terminal receiving grooves defined by a partition wall, a notch formed at one end portion of the respective partition wall, a plurality of terminals accommodated within the terminal receiving grooves, and an interconnecting portion which electrically interconnects at least two adjacent ones of the plurality of terminal portions each other and is disposed in the notch.

In this manner, when inserting the terminals respectively into the terminal receiving grooves, the interconnecting portion, interconnecting the terminals, is disposed in the notch immediately before this inserting operation is completed. Therefore, the interconnecting portion will not adversely affect the insertion of the terminal portions into the housing, and the mounting of the terminal portions in the housing can be effected easily.

Further, the terminals, each having one terminal portion, and the joint terminal can be provided in a mixed manner in the housing. In the connector, it is not particularly necessary to design the partition walls in accordance with the arrangement of these terminals, and therefore the general purpose nature of the housing is also enhanced.

According to the second aspect of the present invention, the interconnecting portion further includes an intermediate portion and opposite end portions, wherein the intermediate portion is disposed on the notch, and wherein respective end portions press against opposite sides of the partition wall to hold the partition wall therebetween. The housing has a cover for covering above of the terminal receiving grooves, and an abutment portion abutting against upper surface of the notch is formed at an end portion of the cover corresponding the notch of the partition wall.

In this manner, the interconnecting portion of the joint terminal is disposed in the notch, and therefore the interconnecting portion is prevented from projecting upwardly from the partition wall.

Further, the interconnecting portion holds the partition wall therebetween, so that the terminal portions are supported by the partition wall. Therefore, the shaking of the joint terminal (having the interconnecting portion) relative to the housing is prevented, and the efficiency of the wire-connecting operation is enhanced.

Still further, the abutment portion of the cover of the housing prevents the displacement and shaking of the interconnecting portion disposed in the notch.

According to the third aspect of the present invention, the notch is formed in a proximal portion of the partition wall. A recess for receiving the interconnecting portion is formed in that portion of a bottom plate of the housing corresponding to the notches. The interconnecting portion is bent so as to project downwardly, wherein the size of the interconnecting portion is substantially the same as the size of the recess to be accommodated therein.

In this manner, the interconnecting portion can be disposed over the inner bottom surface of the housing, and the partition wall prevents the interconnecting portion from being lifted since the notch is formed in the lower portion of the partition wall.

Further, the terminal portions can be stably mounted on the housing since the interconnecting portion is received in the recess in the inner bottom surface of the connector.

According to the fourth aspect of the present invention, the notch is formed over an entire height of the partition wall from the proximal portion thereof to the upper end thereof, wherein the length of the notch along the partition wall is substantially same as the width of the interconnecting portion along the partition wall. The interconnecting portion is bent so as to project upwardly, wherein one end of the interconnecting portion is abutted against the notch.

In this manner, the housing can be easily molded since the rear end portions of the partition walls are removed by an amount corresponding to the width of the interconnecting portion, and the cost for a mold can be reduced.

BRIEF DESCRIPTION OF THE DRAWINGS

In the accompanying drawings:

FIG. 7(*b*) is a front-elevational view of this joint terminal;

FIG. 9(*b*) is a side-elevational view of this joint terminal;

FIG. 9(*c*) is a front-elevational view of this joint terminal.

DETAILED DESCRIPTION OF THE PREFERRED EMBODIMENTS

Preferred embodiments of connectors of this invention will be described below with reference to the drawings.

1. First Embodiment

Figure 1:
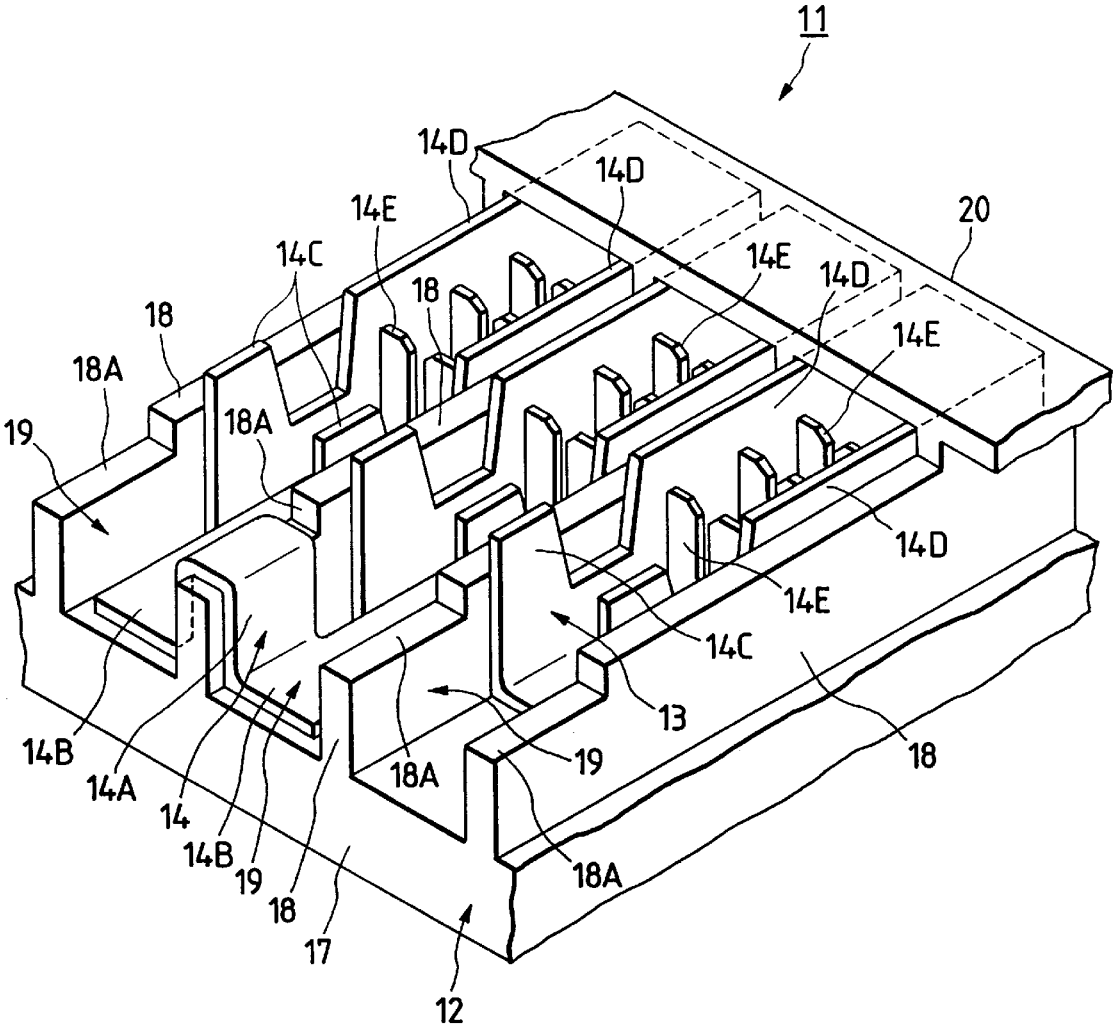
FIG. 1 is a perspective view of an important portion of a first embodiment of a connector of this invention.
Figure 2:
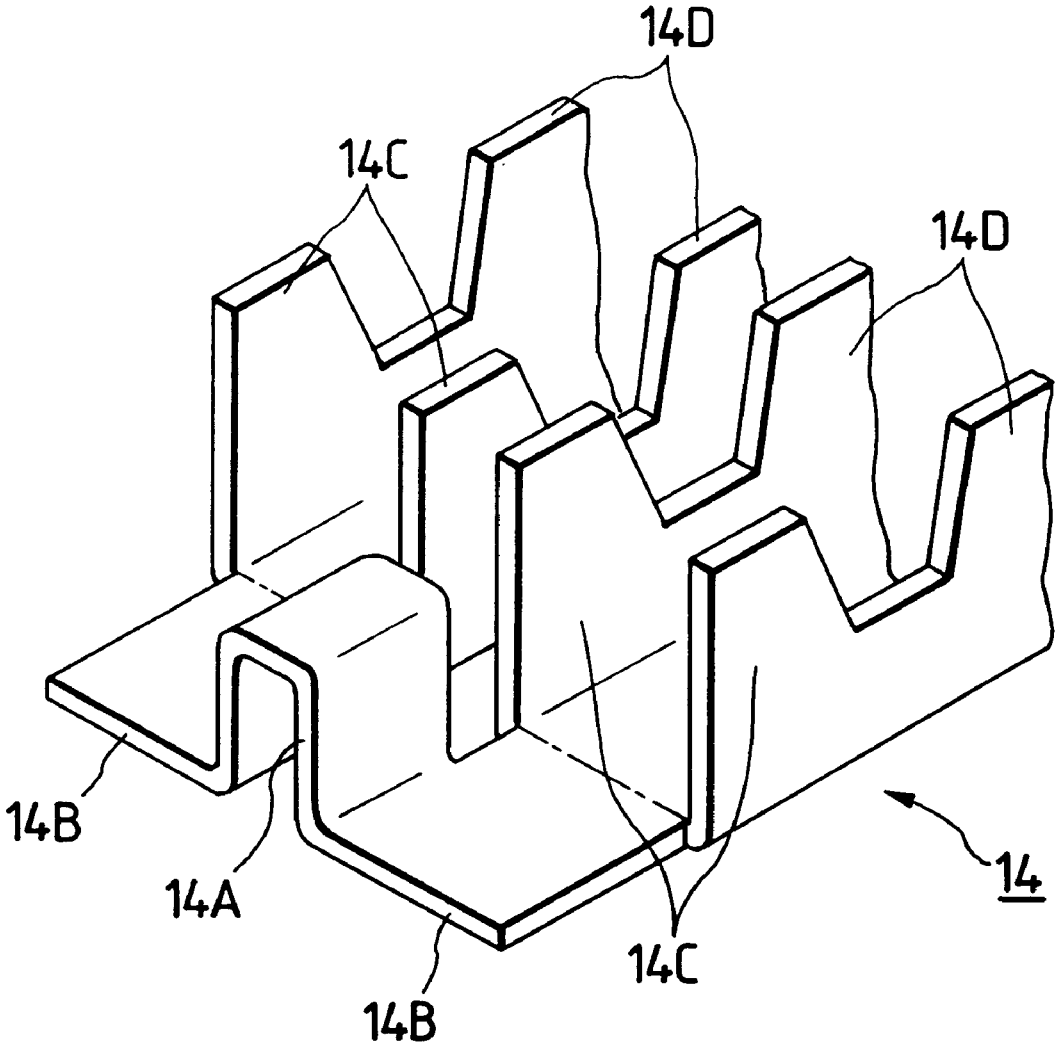
FIG. 2 is a perspective view of an important portion of a joint terminal used in the first embodiment.
Figure 3:
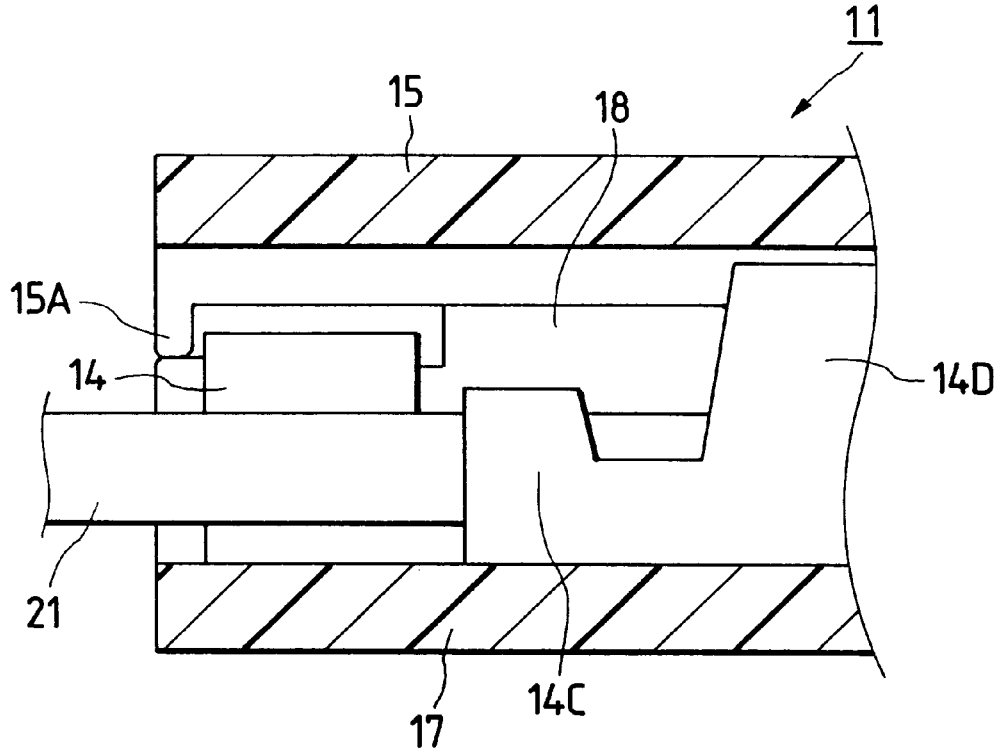
FIG. 3 is a cross-sectional view of an important portion of the connector of the first embodiment.
Figure 4:
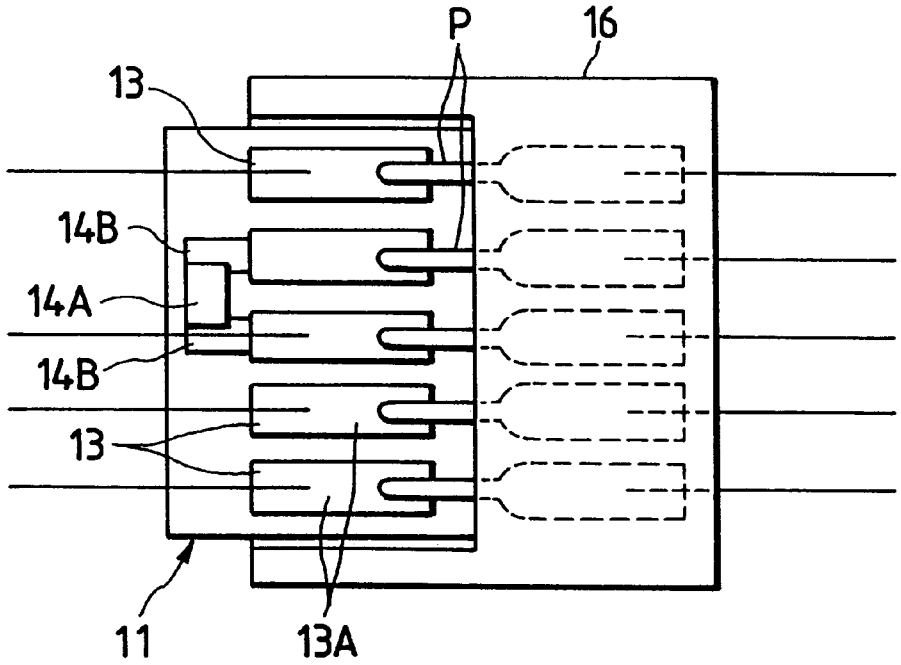
FIG. 4 is a plan view showing a connected condition of the connector of the first embodiment.

FIGS. 1 to 4 show a first embodiment of a connector of the present invention. FIG. 1 is a perspective view of an important portion of the connector 11 of this embodiment, showing a condition in which a cover 15 of a housing 12 is removed. FIG. 2 is a perspective view of an important portion of a joint terminal 14, FIG. 3 is a cross-sectional view of an important portion of the connector, and FIG. 4 is a plan view showing a connected condition of the connector.

The connector 11 broadly comprises the housing 12 made, for example, of an electrically-insulative synthetic resin, a terminal 13 having one terminal portion 13A which is received in the housing 12, the joint terminal 14 having an integral construction in which, for example, two terminal portions 14B connected together, and the cover 15. For example, this connector 11 is connected to its mating connector 16 as shown in FIG. 4.

First, the construction of the housing 12 will be described. The housing 12 includes a plurality of parallel partition walls (cavity walls) 18 extending upright from an upper surface of a rectangular bottom plate 17 of the housing 12. The housing has terminal receiving grooves 19 each formed between the adjacent partition walls 18, and the terminal 13 and the joint terminal 14 are received respectively in these terminal receiving grooves 19.

One longitudinal end portions of the partition walls 18, that is, front end portions in a direction of insertion of the terminal portions, are slightly higher than the other portions thereof, and a transverse plate portion 20 is formed integrally on upper ends of these higher portions. The transverse plate portion 20, the juxtaposed partition walls 18 and the housing bottom plate 17 jointly form openings or ports into which mating connection terminals P (FIG. 4), projecting from the mating connector 16, are inserted, respectively.

A notch 18A, having a predetermined length, is formed in an upper edge of the other longitudinal end portion of each partition wall 18, that is, a rear end portion in the direction of insertion of the terminal portions. Namely, the upper edge of the rear end portion of each partition wall 18 is stepped to have a lower height.

Next, the construction of the terminal 13, as well as the construction of the joint terminal 14, will be described. As shown in FIGS. 1 and 2, the joint terminal 14 includes the two parallel terminal portions 14B formed integrally interconnected by an interconnecting portion 14A formed by bending a metal sheet in a channel-shaped cross-section. The height of the interconnecting portion 14A is equal to the height of that portion of the partition wall 18 having the notch 18A, and the distance between opposed walls of the interconnecting portion 14A is equal to the thickness of the partition wall 18, and the length of the interconnecting portion 14A in the direction of the length of the partition wall 18 is equal to the length of the notch 18A. The opposed walls of the interconnecting portion 14A are resiliently pressed respectively against the opposite sides or surfaces of the partition wall 18 to hold this partition wall 18 therebetween.

Each of the terminal portions 14B has wire support piece portions 14C each extending upwardly from opposite side edges thereof. These wire support piece portions 14C are bent inwardly to hold a wire. Wire connection piece portions 14D each extending upwardly from the opposite side edges of the terminal portion 14B, and are disposed forwardly of the wire support piece portions 14C. A plurality of press-connecting blades 14E are formed on each of opposed inner surfaces of the wire connection piece portions 14D, and these press-connecting blades 14E cut a shield sheath resin of the wire to come into electrical contact with a conductor of the wire.

Although this joint terminal 14 is formed into the construction having the two interconnected terminal portions 14B, there may be previously prepared a terminal structure of a multiple connected construction having many interconnected terminal portions, in which case a double-terminal joint terminal, a triple-terminal joint terminal and so on can be easily formed by cutting this terminal structure at a lower edge (proximal portion) of the interconnecting portion 14. The terminals each having one terminal portion 14B, that is, the terminal 13, can be formed by cutting the joint terminal along a chain line shown in FIG. 2. Thus, by preparing the terminal structure of a multiple connected construction, various kinds of terminal portions can be obtained.

The joint terminal 14, as well as the terminals 13, can be mounted in the housing 12 merely by inserting an end portion thereof which remotes from the interconnecting portion 14A (the front end portion in the inserting direction) into the cavities formed by the transverse plate portion 20, the partition walls 18 and the bottom plate 17. As shown in FIG. 3, the cover 15 has a rectangular shape, and covers the upper side of the housing 12 over an area from the rear end of the housing 12 to the rear end of the transverse plate portion 20. A retaining portion 15A is formed on and projects downwardly from a rear end of the cover 15, and the retaining portion 15A is abutted against the rear ends of the upper edges of the partition walls 18 having the respective notches 18A. The retaining portion 15A is thus abutted against the partition walls 18 (see FIG. 3), thereby preventing the interconnecting portion 14A from being displaced out of place. In FIG. 3, reference numeral 21 denotes the wire connected to the joint terminal.

When the connector 11 of this construction is fitted into the mating connector 16 as shown in FIG. 4, the connector 11 is connected to a predetermined circuit.

In this embodiment, since the notch 18A is formed in the upper edge of the rear end portion of each partition wall 18 of the housing 12, and with this construction, the joint terminals 14 having the interconnecting portion 14A and the terminals 13 each having one terminal portion can be mounted in a mixed manner in the housing 12, and therefore the general purpose natures of the housing 12 and the terminals 13 and 14 can be improved. And besides, since the interconnecting portion 14A is supported by the partition wall 18, the stability of the wire connection and the efficiency of the connecting operation can be improved.

Furthermore, the interconnecting portion 14A is formed by bending the relevant portion, and therefore that portion to be bent into the interconnecting portion 14A have a sufficient length or width. In this case, also sufficient lengths of that portions being the wire support piece portions 14C or the wire connecting piece portions 14D can be obtained because the joint terminal is integrally formed by punching a metal plate as described before. This fact also helps to improve the stability of the wire connection.

As is clear from the above description, in this embodiment, when inserting the terminal portions respectively into the terminal receiving grooves, the interconnecting portion, interconnecting the terminal portions, is disposed in the notch immediately before this inserting operation is completed. Therefore, the interconnecting portion will not adversely affect the insertion of the terminal portions into the housing, and the mounting of the terminal portions in the housing can be effected easily.

Those terminals each having only one terminal portion can be formed merely by cutting the terminal of a multiple connected construction having many interconnected terminal portions, and therefore it is not necessary to prepare terminals having various patterns of terminal portions, so that the general purpose nature of the terminals are enhanced.

Further, the terminals, each having one terminal portion, and the joint terminal, having a plurality of terminal portions, can be provided in a mixed manner in the housing. In the connector in which the terminals, each having only one terminal portion, and the joint terminal are provided in a mixed manner, it is not particularly necessary to design the partition walls in accordance with the arrangement of these terminals, and therefore the general purpose nature of the housing is also enhanced. And besides, since the notch is formed in the rear end portion of each partition wall, intermediate portions (and front end portions) of the terminal portions, to which wires are connected, respectively, are positively separated from one another by the partition walls, and therefore the short-circuiting is prevented from accidentally occurring between the adjacent terminal portions.

Still further, the interconnecting portion of the joint terminal is disposed in the notch, and therefore the interconnecting portion is prevented from projecting upwardly from the partition wall.

Still further, the interconnecting portion holds the partition wall therebetween, so that the terminal portions are supported by the partition wall. Therefore, the shaking of the joint terminal (having the interconnecting portion) relative to the housing is prevented, and the efficiency of the wire-connecting operation is enhanced.

Still further, the abutment portion of the cover of the housing prevents the displacement and shaking of the interconnecting portion disposed in the notch.

2. Second Embodiment

Figure 5:
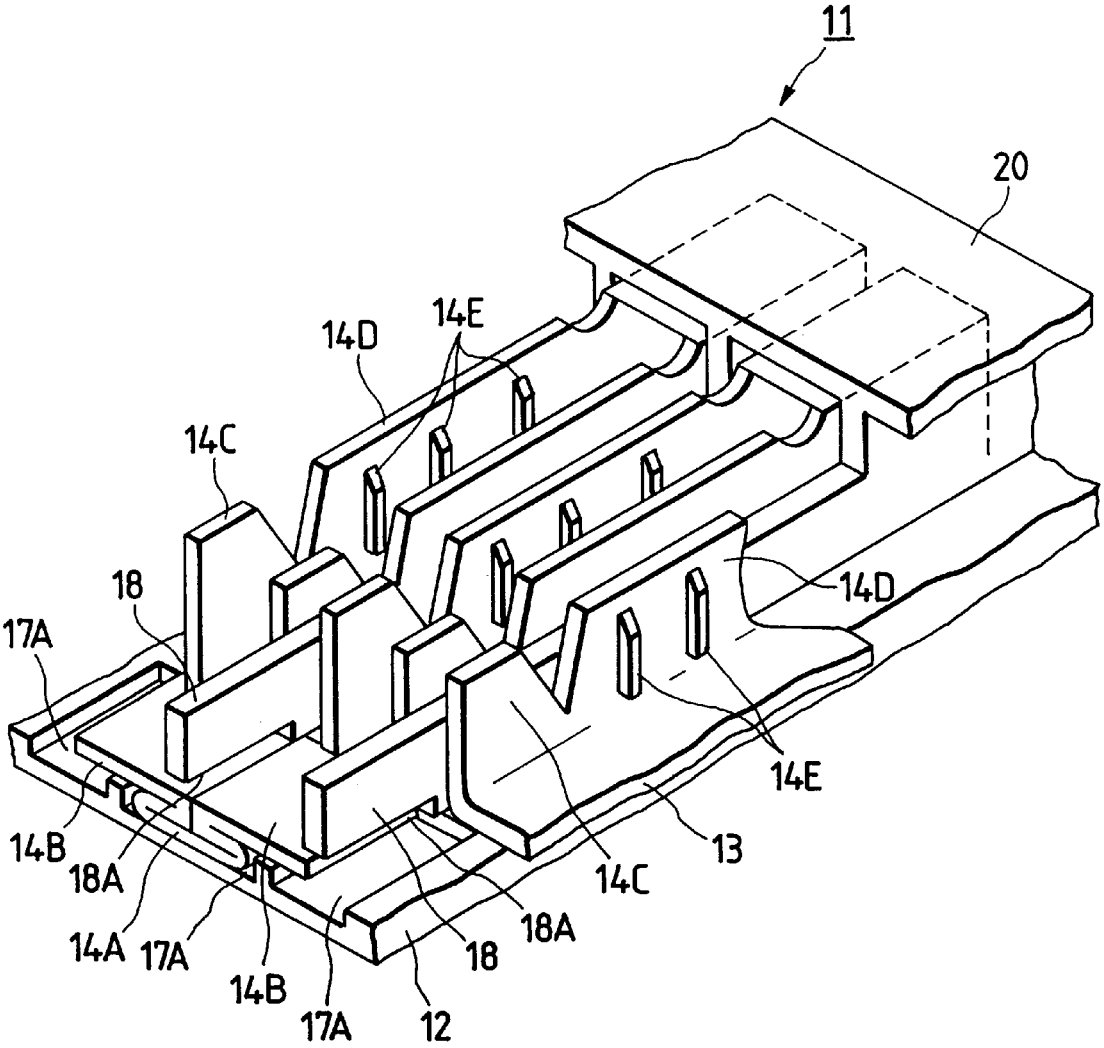
FIG. 5 is a perspective view of an important portion of a second embodiment of a connector of the present invention.
Figure 6:
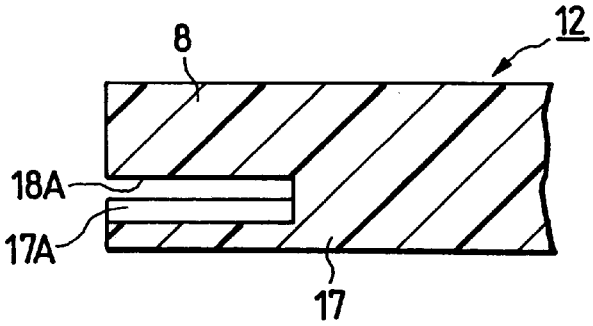
FIG. 6 is a vertical cross-sectional view of a rear end portion of a partition wall in the second embodiment.
Figure 7A:
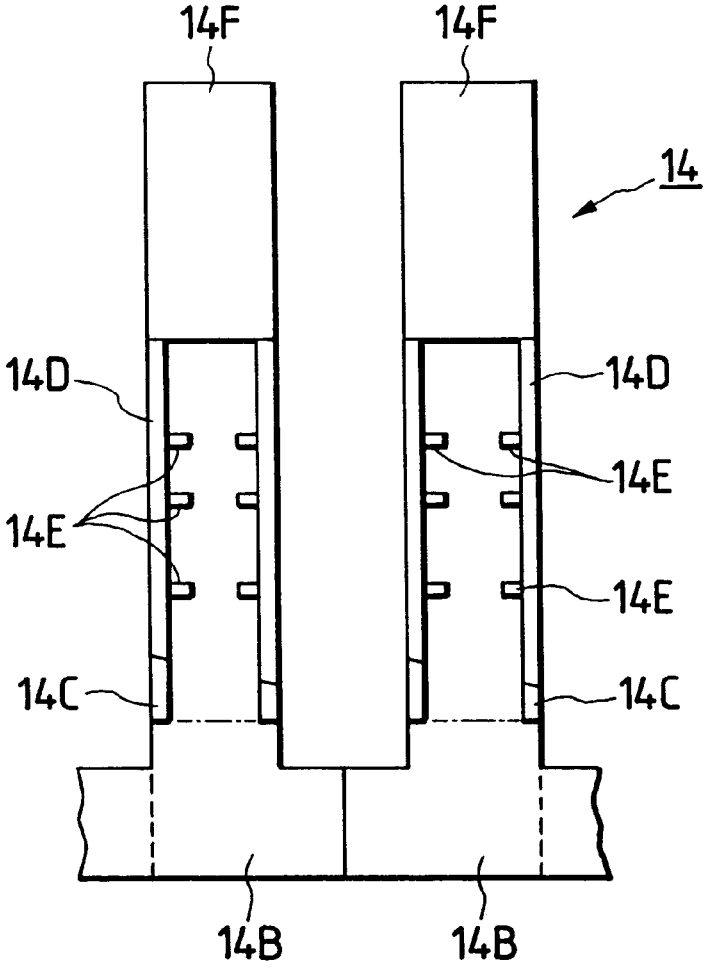
FIG. 7(*a*) is a plan view of a joint terminal used in the second embodiment.
Figure 7B:
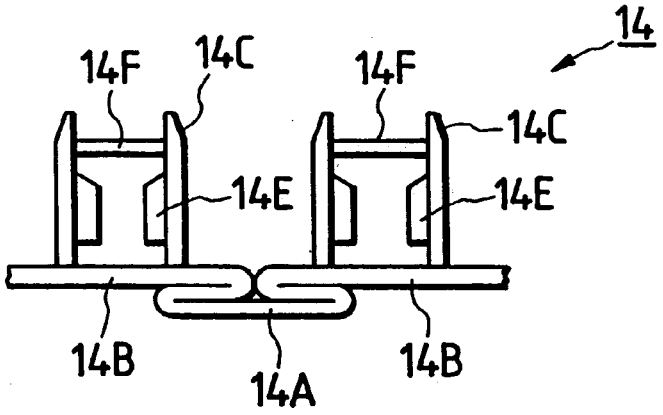

FIGS. 5 to 7 show a second embodiment of a connector of the present invention. In this embodiment, explanation of those portions identical to those of the above first embodiment will be omitted.

A notch (slit) 18A is formed in a lower portion of a rear end portion of each of partition walls 18 of a housing 12, and extends along the inserting direction of the terminals. A length of the notch 18A is substantially equal to a width of an interconnecting portion 14A of a joint terminal 14. Interconnecting portion receiving recesses 17A of a predetermined width are formed in that portion of a bottom plate 17 where the notches 18A are formed.

As shown in FIGS. 5 and 7(*b*), the interconnecting portion 14A of the joint terminal 14 is crushly bent at a lower side of the joint terminal 14, and projects slightly downwardly from the lower side. When the joint terminal 14 is inserted into the housing 12, the bent interconnecting portion 14A is received in the interconnecting portion receiving recess 17A. At this time, a front end of the interconnecting portion 14A is abutted against a front end of the interconnecting portion receiving recess 1 A, thereby preventing the joint terminal 14 from being further inserted. Side edge portions of terminal portions 14B at the rear end portion of the joint terminal 14 are received in the respective notches 18A, and therefore the terminal portions 14B are prevented from being lifted.

A transverse interconnecting plate 14F is formed on and extends between upper edges of front end portions of opposed walls of each terminal portion 14B of the joint terminal 14. Terminals 13 each having one terminal portion can be formed by cutting the joint terminal along chain lines shown in FIG. 7(*a*). The other construction of this embodiment is the same as described above in the first embodiment.

In this embodiment, the interconnecting portion can be disposed over the inner bottom surface of the housing, and the partition wall prevents the interconnecting portion from being lifted since the notch is formed in the lower portion of the partition wall.

Further, the terminal portions can be stably mounted on the housing since the interconnecting portion is received in the recess in the inner bottom surface of the connector.

Still further, the interconnecting portion is formed by bending the relevant portion, and therefore that portion to be bent into the interconnecting portion have a sufficient length or width. In this case, also sufficient lengths of that portions being the wire support piece portions or the wire connecting piece portions can be obtained because the joint terminal is integrally formed by punching a metal plate as described before. This fact also helps to improve the stability of the wire connection.

Another operations and effects of this embodiment are similar to those as described above in the first embodiment.

3. Third Embodiment

Figure 8:
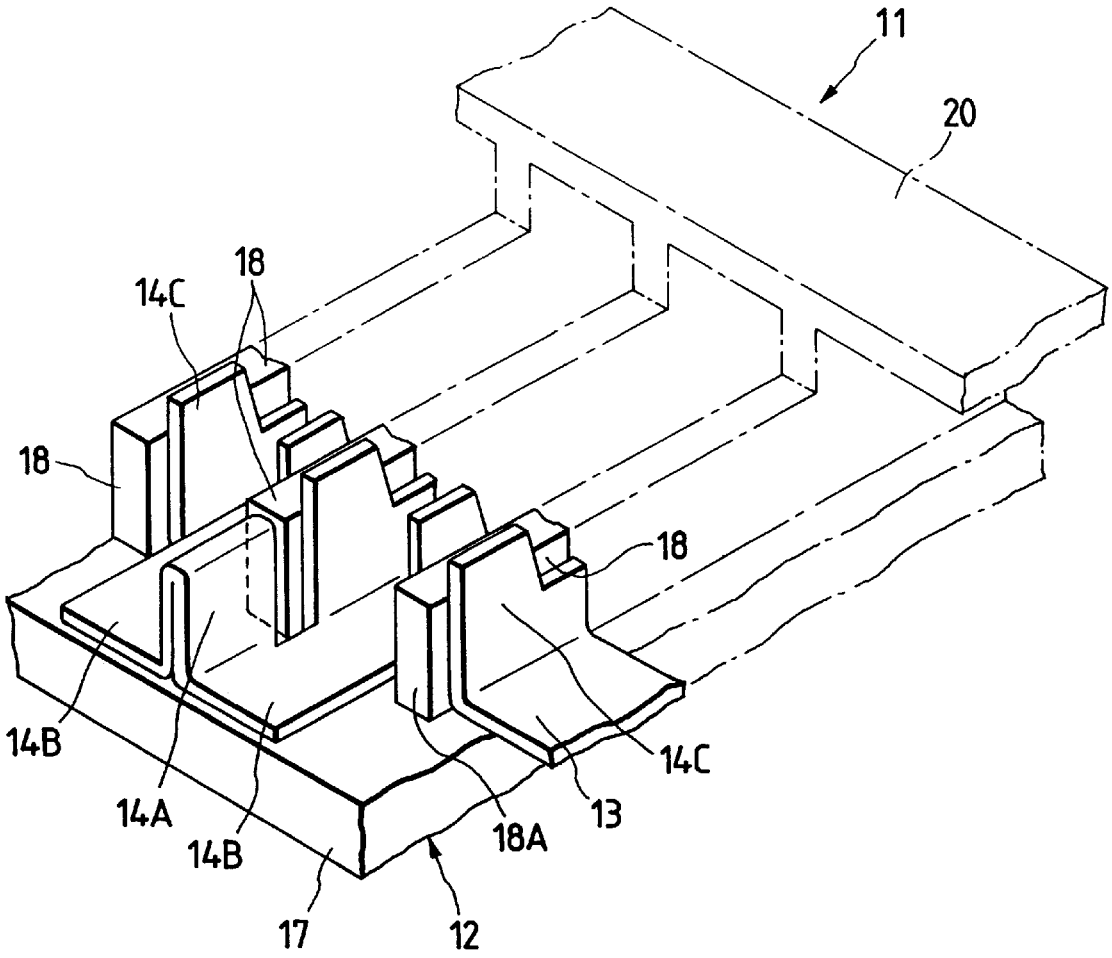
FIG. 8 is a perspective view of an important portion of a third embodiment of a connector of the present invention.
Figure 9A:
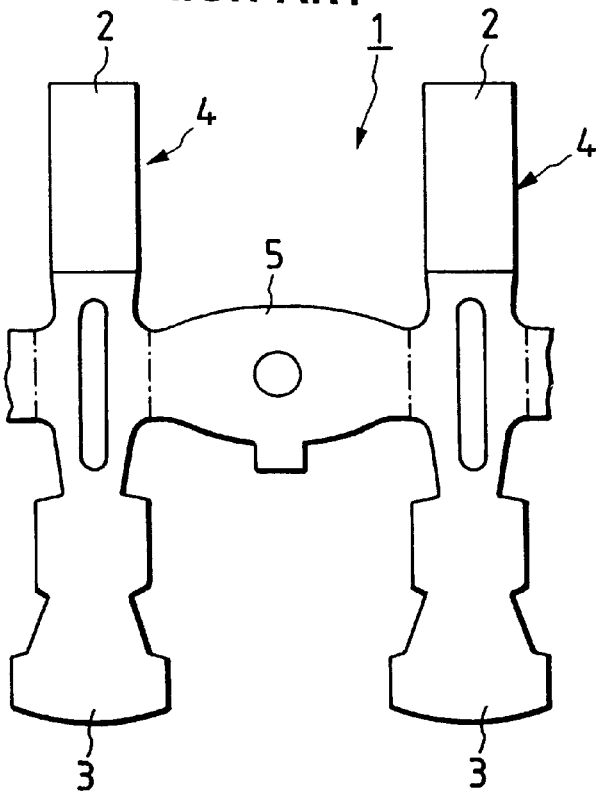
FIG. 9(a) PRIOR ART
FIG. 9(*a*) is a bottom view of a joint terminal used in a conventional connector.
Figure 9B:
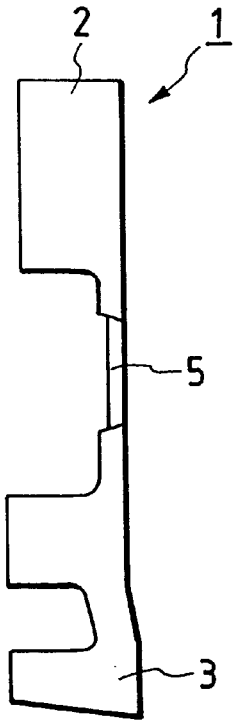
FIG. 9(b) PRIOR ART
Figure 9C:
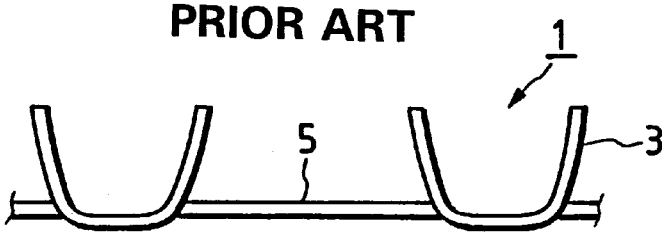
FIG. 9(c) PRIOR ART

FIG. 8 is a perspective view of an important portion of a third embodiment of a connector of the present invention. In this embodiment, explanation of those portions identical to those of the above first embodiment will be omitted.

In this embodiment, notches 18A, formed respectively in partition walls 18 of a housing 12, are formed by removing those portions of the partition walls 18 extending forwardly from a rear end of a bottom plate 17 over a distance equal to a width of an interconnecting portion 14A. Namely, that portion of the bottom plate 17 where the notches 18A are formed is exposed. The interconnecting portion 14A is formed by an upwardly-extending, double folded portion, and has a height substantially equal to the height of the partition wall 18. Therefore, a front end of the interconnecting portion 14A is abutted against a rear end of the partition wall 18.

In this embodiment, the housing can be easily molded since the rear end portions of the partition walls are removed by an amount corresponding to the width of the interconnecting portion, and the cost for a mold can be reduced.

Further, the interconnecting portion is formed by bending the relevant portion, and therefore that portion to be bent into the interconnecting portion have a sufficient length or width. In this case, also sufficient lengths of that portions being the wire support piece portions or the wire connecting piece portions can be obtained because the joint terminal is integrally formed by punching a metal plate as described before. This fact also helps to improve the stability of the wire connection.

Another operations and effects of this embodiment are similar to those as described above in the first and second embodiments.

Although the present invention has been described by way of the first to third embodiments, the present invention is not limited to these embodiments, but various modifications can be made. For example, in the above embodiments, although the joint terminal 14 has the two terminal portions, the joint terminal may have three or more terminal portions, depending on the design of a circuit.

What is claimed is:

1. A connector comprising:

a housing;

a plurality of terminal receiving grooves defined by a partition wall;

a notch formed at one end portion of the respective partition wall;

a plurality of terminals accommodated within the terminal receiving grooves; and an interconnecting portion which electrically interconnects at least two adjacent ones of the plurality of terminal portions to each other and is disposed in the notch, wherein said interconnecting portion includes a substantially U-shaped portion that saddles the partition wall in said notch.

2. The connector as set forth claim 1, wherein the notch is formed in an upper portion of the partition wall.

3. The connector as set forth in claim 2, wherein the U-shaped portion includes an intermediate portion and opposite end portions, and wherein the intermediate portion is disposed on the notch, and wherein respective end portions press against opposite sides of the partition wall to hold the partition wall therebetween.

4. The connector as set forth in claim 2, wherein the housing has a cover for covering the terminal receiving grooves, and an abutment portion, abutting against an upper surface of the notch, which is formed at an end portion of the cover corresponding to the notch of the partition wall.

5. The connector as set forth in claim 3, wherein the housing has a cover for covering the terminal receiving grooves, and an abutment portion, abutting against an upper surface of the notch, which is formed at an end portion of the cover corresponding to the notch of the partition wall.

6. A connector comprising:

a housing;

a plurality of terminal receiving grooves defined by a partition wall;

a notch formed in said partition wall immediately adjacent a base of said housing, such that said notch is defined by said partition wall and said base at one end portion of the respective partition wall;

a plurality of terminals accommodated within the terminal receiving grooves; and an interconnecting portion which electrically interconnects at least two adjacent ones of the plurality of terminal portions to each other and is disposed in the notch.

7. The connector as set forth in claim 6, wherein a recess for receiving the interconnecting portion is formed in a portion of a bottom plate of the housing corresponding to the notch.

8. The connector as set forth in claim 7, wherein the interconnecting portion is bent so as to project downwardly, and wherein the size of the interconnecting portion is substantially the same as the size of the recess to be accommodated therein.

9. A connector comprising:

a housing;

a plurality of terminal receiving grooves defined by a partition wall;

a notch formed at one end portion of the respective partition wall;

a plurality of terminals accommodated within the terminal receiving grooves; and an interconnecting portion which electrically interconnects at least two adjacent ones of the plurality of terminal portions to each other and is disposed in the notch, wherein the housing has a cover for covering the terminal receiving grooves, and an abutment portion, abutting against an upper surface of the notch, which is formed at an end portion of the cover corresponding to the notch of the partition wall.

10. The connector as set forth in claim 9, wherein the notch is formed in an upper portion of the partition wall.

11. The connector as set forth in claim 10, wherein the interconnecting portion includes an intermediate portion and opposite end portions, and wherein the intermediate portion is disposed on the notch, and wherein respective end portions press against opposite sides of the partition wall to hold the partition wall therebetween.

* * * * *